US010750782B2

(12) United States Patent
Batista

(10) Patent No.: US 10,750,782 B2
(45) Date of Patent: Aug. 25, 2020

(54) AEROSOL-GENERATING SYSTEM COMPRISING CARTRIDGE DETECTION

(71) Applicant: Philip Morris Products S.A., Neuchatel (CH)

(72) Inventor: Rui Nuno Batista, Morges (CH)

(73) Assignee: Philip Morris Products S.A., Neuchatel (CH)

( * ) Notice: Subject to any disclaimer, the term of this patent is extended or adjusted under 35 U.S.C. 154(b) by 326 days.

(21) Appl. No.: 15/323,886

(22) PCT Filed: Jul. 10, 2015

(86) PCT No.: PCT/EP2015/065913
§ 371 (c)(1),
(2) Date: Jan. 4, 2017

(87) PCT Pub. No.: WO2016/005602
PCT Pub. Date: Jan. 14, 2016

(65) Prior Publication Data

US 2017/0150755 A1 Jun. 1, 2017

(30) Foreign Application Priority Data

Jul. 11, 2014 (EP) ..... 14176826

(51) Int. Cl.
*A24F 47/00* (2020.01)
*H05B 1/02* (2006.01)

(52) U.S. Cl.
CPC ..... *A24F 47/008* (2013.01); *H05B 1/0244* (2013.01); *H05B 2203/021* (2013.01)

(58) Field of Classification Search
CPC ..... A24F 47/008; G01F 23/2928
See application file for complete search history.

(56) References Cited

U.S. PATENT DOCUMENTS 5,388,594 A 2/1995 Counts et al.
5,505,214 A 4/1996 Collins et al.
(Continued)

FOREIGN PATENT DOCUMENTS

CN 1122213 A 5/1996
CN 102595943 A 7/2012
(Continued)

OTHER PUBLICATIONS

European Search Report dated Jan. 21, 2015 in Application No. 14 17 6826.
(Continued)

*Primary Examiner* — Serkan Akar
*Assistant Examiner* — Ahmad Abdel-Rahman
(74) *Attorney, Agent, or Firm* — Oblon, McClelland, Maier & Neustadt, L.L.P.

(57) ABSTRACT

An electrically operated aerosol-generating system is provided, including an aerosol-generating device, and first and second removable aerosol-forming cartridges each including a resistive heater. The first cartridge includes a first aerosol-forming substrate having a first heating profile and the second cartridge includes a second aerosol-forming substrate having a second heating profile. The device includes a main body defining a cavity and at least one opening configured to removably receive one of the first and second cartridges in the cavity; an electrical power supply and a controller configured to control a supply of electrical current from the power supply to the heater, to detect whether the first or second cartridge has been received within the cavity based upon a resistive load of the respective heater, and to control the supply of electrical current to the heater according to either the first or the second heating profile in response to a detected cartridge.

13 Claims, 4 Drawing Sheets

(56) References Cited

U.S. PATENT DOCUMENTS

| | | | | |
|---|---|---|---|---|
| 5,591,368 | A | 1/1997 | Fleischhauer et al. | |
| 2012/0260927 | A1 | 10/2012 | Liu | |
| 2013/0340750 | A1 | 12/2013 | Thorens et al. | |
| 2014/0026887 | A1* | 1/2014 | Portney | A61M 15/0028 128/203.21 |
| 2014/0096782 | A1 | 4/2014 | Ampolini et al. | |
| 2014/0123989 | A1 | 5/2014 | Lamothe | |
| 2014/0253144 | A1* | 9/2014 | Novak, III | A24F 47/008 324/550 |
| 2014/0305449 | A1 | 10/2014 | Plojoux et al. | |

FOREIGN PATENT DOCUMENTS

| | | | |
|---|---|---|---|
| CN | 203505587 | U | 4/2014 |
| CN | 103859609 | A | 6/2014 |
| EP | 0 857 431 | A1 | 8/1998 |
| EP | 1 736 062 | A2 | 12/2006 |
| EP | 2 399 636 | A1 | 12/2011 |
| EP | 2 460 423 | A1 | 6/2012 |
| JP | WO 2013/111320 | A1 | 8/2013 |
| JP | 2014-501107 | A | 1/2014 |
| TW | 201206357 | A1 | 2/2012 |
| WO | WO 2007/024130 | A1 | 3/2007 |
| WO | WO 2007/066374 | A1 | 6/2007 |
| WO | WO 2007/131449 | A1 | 11/2007 |
| WO | WO 2007/131450 | A1 | 11/2007 |
| WO | WO 2010/045670 | A1 | 4/2010 |
| WO | WO 2010/045671 | A1 | 4/2010 |
| WO | WO 2011/109848 | A1 | 9/2011 |
| WO | WO 2011/109849 | A1 | 9/2011 |
| WO | WO 2012/106739 | A1 | 8/2012 |
| WO | WO 2013/013808 | A1 | 1/2013 |
| WO | WO 2013/057185 | A1 | 4/2013 |
| WO | 2013/098395 | A1 | 7/2013 |
| WO | WO-2014201432 | A1 * | 12/2014 ..... A24F 47/008 |

OTHER PUBLICATIONS

International Search Report and Written Opinion dated Oct. 30, 2015 in PCT/EP2015/065913 Filed Jul. 10, 2015.

Combined Office Action and Search Report dated Jan. 4, 2019 in Chinese Patent Application No. 201580033318.2, 23 pages (with English translation).

Combined Office Action and Search Report dated Aug. 19, 2019 in Chinese Patent Application No. 201580033318.2, 21 pages (with English translation).

Office Action dated Aug. 1, 2019 in Japanese Patent Application No. 2017-501385, 3 pages (with English transition).

* cited by examiner

AEROSOL-GENERATING SYSTEM COMPRISING CARTRIDGE DETECTION

The present invention relates to an aerosol-generating system configured to detect and recognise different types of aerosol-forming cartridge. The present invention finds particular application as an aerosol-generating system for heating a nicotine-containing aerosol-forming substrate.

One type of aerosol-generating system is an electrically operated smoking system. Handheld electrically operated smoking systems consisting of an electric heater, an aerosol-generating device comprising a battery and control electronics, and an aerosol-forming cartridge are known.

Aerosol-forming cartridges for electrically heated smoking systems are typically specially designed to function only with a corresponding aerosol-generating device, because the flavours are generated and released by a controlled heating of the aerosol-forming substrate. Therefore, attempting to use an aerosol-forming cartridge with an aerosol-generating device produced by a different manufacturer, for example, may fail to produce the desired aerosol composition and may damage one or both of the aerosol-forming cartridge and the aerosol-generating device. In addition, there may be a number of different aerosol-forming cartridges that are each configured for use with the same device, but which each provide a different aerosol composition and require different heating profiles.

Some of the electrically heated smoking systems of the prior art include a detector which is able to detect the presence of a smoking article or cartridge received in the smoking device. Typically, known systems print identifiable ink on the surface of the article or cartridge, which is then detected by the device. However, such detection systems offer limited functionality and reliability.

Accordingly, it would be desirable to produce an electrically operated aerosol-generating system that provides a consistent and reliable means of detecting the presence of an aerosol-forming cartridge within an aerosol-generating device, as well as detection system having improved functionality.

According to the present invention there is provided an electrically operated aerosol-generating system comprising an aerosol-generating device, a first removable aerosol-forming cartridge comprising at least a first resistive heater, and a second removable aerosol-forming cartridge comprising at least a second resistive heater. The first removable aerosol-forming cartridge comprises a first aerosol-forming substrate requiring a first heating profile and the second removable aerosol-forming cartridge comprises a second aerosol-forming substrate requiring a second heating profile. The aerosol-generating device comprises a main body defining a cavity and at least one opening for removably receiving one of the first and second aerosol-forming cartridges in the cavity. The aerosol-generating device further comprises an electrical power supply and a control unit for controlling a supply of electrical current from the electrical power supply to the first or second resistive heater. The first aerosol-forming cartridge comprises a first electrical load comprising the resistive load of the first resistive heater and configured to electrically connect with the control unit when the first aerosol-forming cartridge is received within the cavity. The second aerosol-forming cartridge comprises a second electrical load comprising the resistive load of the second resistive heater and configured to electrically connect with the control unit when the second aerosol-forming cartridge is received within the cavity, wherein the second electrical load is different to the first electrical load. The control unit is configured to measure the electrical load when an aerosol-forming cartridge is received within the cavity to detect whether the first or second aerosol-forming cartridge has been received within the cavity. The control unit is arranged to control the supply of electrical current to the first resistive heater or the second resistive heater according to either the first or the second heating profile based at least in part on the measured electrical load.

As used herein, the term "aerosol-generating system" refers to the combination of an aerosol-generating device, an aerosol-forming cartridge and a heater, as further described and illustrated herein. In the system, the device, the cartridge and the heater cooperate to generate an aerosol.

As used herein, the term "aerosol-generating device" refers to a device that interacts with an aerosol-forming cartridge and a heater to generate an aerosol. The aerosol-generative device includes an electric power supply to operate the heater for heating the aerosol-forming cartridge.

As used herein, the term "cartridge" refers to a consumable article which is configured to couple to an aerosol-generating device and which is assembled as a single unit that can be coupled and uncoupled as a single unit.

As used herein, the term "aerosol-forming cartridge" refers to a cartridge comprising at least one aerosol-forming substrate that is capable of releasing volatile compounds that can form an aerosol. For example, an aerosol-forming cartridge may be a smoking article that generates an aerosol.

As used herein, the term 'aerosol-forming substrate' is used to describe a substrate capable of releasing volatile compounds, which can form an aerosol. The aerosols generated from aerosol-forming substrates of aerosol-forming cartridges according to the invention may be visible or invisible and may include vapours (for example, fine particles of substances, which are in a gaseous state, that are ordinarily liquid or solid at room temperature) as well as gases and liquid droplets of condensed vapours.

By utilising an electrical detection means, aerosol-generating systems according to the present invention can advantageously detect and distinguish between two or more different aerosol-forming cartridges and provide the required heating profile for the particular cartridge that has been inserted into the device. Furthermore, using an electrical detection method is more reliable than the printed ink system used in prior art aerosol-generating systems, as an electrical detection means is less susceptible to contamination or damage. For example, in the prior art systems, it is possible for the printed ink to rub off before the aerosol-forming cartridge or article is used, therefore preventing use of the cartridge or article with the device.

In some embodiments, the control unit can be configured so that the resistive heater is not activated if the control unit fails to detect a recognised aerosol-forming cartridge. Additionally, the device can be configured to use a mechanical detection means that may prevent the insertion of a non-compatible cartridge into the device. Therefore, aerosol-generating systems according to the present invention can advantageously be configured to additionally reduce or prevent the use of counterfeit or non-compatible aerosol-forming cartridges with the device.

To measure the resistive load of the first or second resistive heater, the control unit can be configured to pass an electrical current from the power supply through the resistive heater and measure the resulting resistance. Resistive loads may be advantageous as they facilitate the use of direct current (DC) to measure the load. Therefore, resistive loads are particularly suited to embodiments in which the power supply is a DC power supply, such as a battery.

Furthermore, utilising the heater itself as the resistive load can eliminate the need for a separate and dedicated electrical load that may otherwise be provided specifically for the purpose of distinguishing between the first and second cartridges.

Providing a first resistive heater as part of the first aerosol-forming cartridge and a second resistive heater as part of the second aerosol-forming cartridge advantageously allows a heater configured specifically for use with each type of cartridge to be provided, which may optimise the aerosol delivery and therefore provide the correct aerosol composition and concentration. At the same time, providing each heater within the corresponding cartridge prevents the user from using an incorrect heater with each type of aerosol-forming cartridge.

In any of the embodiments described above, the first aerosol-forming article may comprise a first data storage device configured to communicate first data to the control unit when the first aerosol-forming device is received within the cavity, and the second aerosol-forming article may comprise a second data storage device configured to communicate second data to the control unit when the second aerosol-forming device is received within the cavity. The second data is different to the first data, and the control unit is arranged to control the supply of electrical current to the first or second resistive heater according to either the first or the second heating profile based in part on the data received by the control unit.

The first and second data stored on the first and second aerosol-forming cartridge may include at least one of the type of aerosol-forming cartridge, the manufacturer, the date and time of manufacture, a production batch number, a heating profile, an indication of the amount of aerosol-forming substrate present in the cartridge, and an indication of whether the aerosol-forming cartridge has been used previously.

Storing the heating profile for the cartridge on the cartridge itself is advantageous, as it can eliminate the need to store numerous different heating profiles in the device. This not only reduces or eliminates the need for data storage in the device, but also eliminates the need to update heating profiles stored on the device in the event that new cartridges requiring new heating profiles are manufactured.

Storing an indication of the amount of aerosol-forming substrate present in the cartridge may be useful in those embodiments in which the heating profile used to heat the aerosol-forming cartridge depends on the amount of aerosol-forming substrate provided on the cartridge. For example, in those embodiments in which the aerosol-forming substrate comprises a liquid, the heating profile may depend on the amount of liquid stored on the cartridge.

Storing an indication of whether the cartridge has been used previously can prevent the reuse of already used cartridges in both the same device and a different device. Preventing reuse of cartridges is often desirable, as reusing an already used cartridge can result in a significantly reduced output of aerosol from the system.

In addition to transmitting data from the first and second aerosol-generating cartridges, or as an alternative to transmitting data, the aerosol-generating device may comprise a first set of electrical contacts and a second set of electrical contacts, wherein the first aerosol-forming cartridge comprises a third set of electrical contacts arranged to contact the first set of electrical contacts when the first aerosol-forming cartridge is received in the cavity, and wherein the second aerosol-forming cartridge comprises a fourth set of electrical contacts arranged to contact the second set of electrical contacts when the second aerosol-forming cartridge is received in the cavity. The control unit is configured to control the supply of electrical current to the first or second resistive heater according to either the first or the second heating profile based in part on whether the aerosol-forming cartridge received within the cavity contacts the first set or the second set of electrical contacts.

Utilising different sets of contacts to provide an electrical connection between the device and each of the first and second cartridges provides a means of determining which type of cartridge has been inserted into the device. For example, the control unit can attempt to pass an electrical current from the power supply through each of the first and second set of contacts to determine which set of contacts is in electrical contact with an aerosol-forming cartridge.

In some embodiments, the aerosol-generating device may use the electrical connection provided by the electrical contacts to perform a check on the cartridge prior to activating the heater. For example, the device may check whether the cartridge has been used previously. Additionally, or alternatively, in those embodiments in which a heater forms part of each cartridge, the device may check correct operation of the heater before starting a full heating cycle.

In some embodiments, the first set of electrical contacts and the second set of electrical contacts share at least one common electrical contact. For example, the first and second set of electrical contacts may share one, two, three, four or five electrical contacts. In some cases, the first set of electrical contacts may be a sub-set of the second set of electrical contacts. That is, the second set of contacts may include all of the contacts in the first set, plus one or more additional contacts. The first and second set of electrical contacts may share any number of electrical contacts, providing at least one of the first and second sets of electrical contacts includes at least one additional contact that does not form part of the other set.

Alternatively, the first and second set of electrical contacts may not share any common contacts.

The electrical contacts may have any suitable form. The electrical contacts may be substantially flat. Advantageously, substantially flat electrical contacts have been found to be more reliable for establishing an electrical connection and are easier to manufacture.

Preferably, the electrical contacts comprise part of a standardised electrical connection, including, but not limited to, USB-A, USB-B, USB-mini, USB-micro, SD, miniSD, or microSD type connections. Preferably, the electrical contacts comprise the male part of a standardised electrical connection, including, but not limited to, USB-A, USB-B, USB-mini, USB-micro, SD, miniSD, or microSD type connections. As used herein, the term "standardised electrical connection" refers an electrical connection which is specified by an industrial standard.

In addition to the optional detection methods described above, or as an alternative to those methods, the at least one opening may comprise a first opening arranged to receive the first aerosol-forming cartridge and a second opening arranged to receive the second aerosol-forming cartridge. Preferably, the first and second openings are configured so that the first aerosol-forming cartridge can be received only within the first opening and the second aerosol-forming cartridge can be received only within the second opening. The control unit is configured to control the supply of electrical current to the first or second resistive heater according to either the first or the second heating profile based in part on whether the aerosol-forming cartridge is received within first or second opening.

Utilising different openings to receive the first and second cartridges provides an at least partially mechanical means for determining which type of cartridge has been inserted into the device. For example, the device may comprise a sensor to determine which opening has received the aerosol-forming cartridge. Suitable sensors include optical sensors, electromechanical sensors, capacitive sensors, and inductive sensors. In a particularly preferred embodiment, the use of two different openings is combined with the use of first, second, third and fourth sets of electrical contacts, as described above. Specifically, the device may be arranged so that the third set of electrical contacts can only contact the first set of electrical contacts when the first cartridge is inserted into the first opening, and the fourth set of electrical contacts can only contact the second set of electrical contacts when the second cartridge is inserted into the second opening.

To prevent insertion of the first and second cartridges into the incorrect opening, the first and second aerosol-forming cartridges preferably have at least one of a different size and a different shape. In one embodiment, the first opening is arranged at an end wall of the cavity and the second opening is arranged along a side wall of the cavity. In this case, the first aerosol-forming cartridge may have a greater maximum length than the second aerosol-forming cartridge and the second aerosol-forming cartridge may have a greater maximum width than the first aerosol-forming cartridge. Therefore, to prevent the insertion of each cartridge into the incorrect opening, the first opening has a maximum width less than the maximum width of the second aerosol-forming cartridge and the second opening has a maximum length less than the maximum length of the first aerosol-forming cartridge.

In any of the embodiments described above, the cavity preferably comprises at least one of a guide slot, a groove, a rail, or a protrusion for guiding one or both of the first and second aerosol-forming cartridges into its correct position within the cavity. In those embodiments comprising first and second openings for receiving the first and second cartridges respectively, preferably at least one of a guide slot, a groove, a rail, or a protrusion is associated with each opening to guide the respective cartridge into its correct position within the cavity.

In any of the embodiments described above, the first and second aerosol-forming cartridges may be substantially flat and the at least one opening may comprise a substantially rectangular slot.

As used herein, the term "substantially flat" refers to a component having a thickness to width ratio of at least about 1:2. Preferably, the thickness to width ratio is less than about 1:20 to minimise the risk of bending or breaking the component.

Flat components can be easily handled during manufacture. In addition, it has been found that aerosol release from the aerosol-forming substrate is improved when it is substantially flat and when arranged so that a flow of air is drawn across the width, length, or both, of the aerosol-forming substrate.

In any of the embodiments described above, the first and second aerosol-forming substrates may each comprise nicotine. For example, each of the first and second aerosol-forming substrates may comprise a tobacco-containing material with volatile tobacco flavour compounds which are released from the aerosol-forming substrate upon heating.

Preferably, the aerosol-forming substrate comprises an aerosol former, that is, a substance which generates an aerosol upon heating. The aerosol former may be, for instance, a polyol aerosol former or a non-polyol aerosol former. It may be a solid or liquid at room temperature, but preferably is a liquid at room temperature. Suitable polyols include sorbitol, glycerol, and glycols like propylene glycol or triethylene glycol. Suitable non-polyols include monohydric alcohols, such as menthol, high boiling point hydrocarbons, acids such as lactic acid, and esters such as diacetin, triacetin, triethyl citrate or isopropyl myristate. Aliphatic carboxylic acid esters such as methyl stearate, dimethyl dodecanedioate and dimethyl tetradecanedioate can also be used as aerosol formers. A combination of aerosol formers may be used, in equal or differing proportions. Polyethylene glycol and glycerol may be particularly preferred, whilst triacetin is more difficult to stabilise and may also need to be encapsulated in order to prevent its migration within the product. The aerosol-forming substrate may include one or more flavouring agents, such as cocoa, liquorice, organic acids, or menthol.

The aerosol-forming substrate may comprise a solid substrate. The solid substrate may comprise, for example, one or more of: powder, granules, pellets, shreds, spaghettis, strips or sheets containing one or more of: herb leaf, tobacco leaf, fragments of tobacco ribs, reconstituted tobacco, homogenised tobacco, extruded tobacco and expanded tobacco. Optionally, the solid substrate may contain additional tobacco or non-tobacco volatile flavour compounds, to be released upon heating of the substrate. Optionally, the solid substrate may also contain capsules that, for example, include the additional tobacco or non-tobacco volatile flavour compounds. Such capsules may melt during heating of the solid aerosol-forming substrate. Alternatively, or in addition, such capsules may be crushed prior to, during, or after heating of the solid aerosol-forming substrate.

Where the aerosol-forming substrate comprises a solid substrate comprising homogenised tobacco material, the homogenised tobacco material may be formed by agglomerating particulate tobacco. The homogenised tobacco material may be in the form of a sheet. The homogenised tobacco material may have an aerosol-former content of greater than 5 percent on a dry weight basis. The homogenised tobacco material may alternatively have an aerosol former content of between 5 percent and 30 percent by weight on a dry weight basis. Sheets of homogenised tobacco material may be formed by agglomerating particulate tobacco obtained by grinding or otherwise comminuting one or both of tobacco leaf lamina and tobacco leaf stems; alternatively, or in addition, sheets of homogenised tobacco material may comprise one or more of tobacco dust, tobacco fines and other particulate tobacco by-products formed during, for example, the treating, handling and shipping of tobacco. Sheets of homogenised tobacco material may comprise one or more intrinsic binders, that is tobacco endogenous binders, one or more extrinsic binders, that is tobacco exogenous binders, or a combination thereof to help agglomerate the particulate tobacco. Alternatively, or in addition, sheets of homogenised tobacco material may comprise other additives including, but not limited to, tobacco and non-tobacco fibres, aerosol-formers, humectants, plasticisers, flavourants, fillers, aqueous and non-aqueous solvents and combinations thereof. Sheets of homogenised tobacco material are preferably formed by a casting process of the type generally comprising casting a slurry comprising particulate tobacco and one or more binders onto a conveyor belt or other support surface, drying the cast slurry to form a sheet of homogenised tobacco material and removing the sheet of homogenised tobacco material from the support surface.

Optionally, the solid substrate may be provided on or embedded in a thermally stable carrier. The carrier may take the form of powder, granules, pellets, shreds, spaghettis, strips or sheets. Alternatively, the carrier may be a tubular carrier having a thin layer of the solid substrate deposited on its inner surface, such as those disclosed in U.S. Pat. Nos. 5,505,214, 5,591,368 and 5,388,594, or on its outer surface, or on both its inner and outer surfaces. Such a tubular carrier may be formed of, for example, a paper, or paper like material, a non-woven carbon fibre mat, a low mass open mesh metallic screen, or a perforated metallic foil or any other thermally stable polymer matrix. The solid substrate may be deposited on the surface of the carrier in the form of, for example, a sheet, foam, gel or slurry. The solid substrate may be deposited on the entire surface of the carrier, or alternatively, may be deposited in a pattern in order to provide a predetermined or non-uniform flavour delivery during use. Alternatively, the carrier may be a non-woven fabric or fibre bundle into which tobacco components have been incorporated, such as that described in EP-A-0 857 431. The non-woven fabric or fibre bundle may comprise, for example, carbon fibres, natural cellulose fibres, or cellulose derivative fibres.

As an alternative to a solid tobacco-based aerosol-forming substrate, each of the first and second aerosol-forming substrates may comprise a liquid substrate and the cartridge may comprise means for retaining the liquid substrate, such as one or more containers. Alternatively or in addition, the cartridge may comprise a porous carrier material, into which the liquid substrate is absorbed, as described in WO-A-2007/024130, WO-A-2007/066374, EP-A-1 736 062, WO-A-2007/131449 and WO-A-2007/131450.

The liquid substrate is preferably a nicotine source comprising one or more of nicotine, nicotine base, a nicotine salt, such as nicotine-HCl, nicotine-bitartrate, or nicotine-ditartrate, or a nicotine derivative.

The nicotine source may comprise natural nicotine or synthetic nicotine.

The nicotine source may comprise pure nicotine, a solution of nicotine in an aqueous or non-aqueous solvent or a liquid tobacco extract.

The nicotine source may further comprise an electrolyte forming compound. The electrolyte forming compound may be selected from the group consisting of alkali metal hydroxides, alkali metal oxides, alkali metal salts, alkaline earth metal oxides, alkaline earth metal hydroxides and combinations thereof.

For example, the nicotine source may comprise an electrolyte forming compound selected from the group consisting of potassium hydroxide, sodium hydroxide, lithium oxide, barium oxide, potassium chloride, sodium chloride, sodium carbonate, sodium citrate, ammonium sulfate and combinations thereof.

In certain embodiments, the nicotine source may comprise an aqueous solution of nicotine, nicotine base, a nicotine salt or a nicotine derivative and an electrolyte forming compound.

Alternatively or in addition, the nicotine source may further comprise other components including, but not limited to, natural flavours, artificial flavours and antioxidants.

In addition to a nicotine-containing aerosol-forming substrate, each of the first and second aerosol-forming substrates may further comprise a source of a volatile delivery enhancing compound that reacts with the nicotine in the gas phase to aid delivery of the nicotine to the user.

The volatile delivery enhancing compound may comprise a single compound. Alternatively, the volatile delivery enhancing compound may comprise two or more different compounds.

Preferably, the volatile delivery enhancing compound is a volatile liquid.

The volatile delivery enhancing compound may comprise an aqueous solution of one or more compounds. Alternatively the volatile delivery enhancing compound may comprise a non-aqueous solution of one or more compounds.

The volatile delivery enhancing compound may comprise two or more different volatile compounds. For example, the volatile delivery enhancing compound may comprise a mixture of two or more different volatile liquid compounds.

Alternatively, the volatile delivery enhancing compound may comprise one or more non-volatile compounds and one or more volatile compounds. For example, the volatile delivery enhancing compound may comprise a solution of one or more non-volatile compounds in a volatile solvent or a mixture of one or more non-volatile liquid compounds and one or more volatile liquid compounds.

In one embodiment, the volatile delivery enhancing compound comprises an acid. The volatile delivery enhancing compound may comprise an organic acid or an inorganic acid. Preferably, the volatile delivery enhancing compound comprises an organic acid, more preferably a carboxylic acid, most preferably an alpha-keto or 2-oxo acid.

In a preferred embodiment, the volatile delivery enhancing compound comprises an acid selected from the group consisting of 3-methyl-2-oxopentanoic acid, pyruvic acid, 2-oxopentanoic acid, 4-methyl-2-oxopentanoic acid, 3-methyl-2-oxobutanoic acid, 2-oxooctanoic acid and combinations thereof. In a particularly preferred embodiment, the volatile delivery enhancing compound comprises pyruvic acid.

As an alternative to a solid or liquid aerosol-forming substrate, each of the first and second aerosol-forming substrates may be any other sort of substrate, for example, a gas substrate, a gel substrate, or any combination of the various types of substrate described.

In any of the embodiments described above, each of the first and second aerosol-forming substrates may comprise a single aerosol-forming substrate. Alternatively, each of the first and second aerosol-forming substrates may comprise a plurality of aerosol-forming substrates. The plurality of aerosol-forming substrates may have the substantially the same composition. Alternatively, the plurality of aerosol-forming substrates may comprise two or more aerosol-forming substrates having substantially different compositions. The plurality of aerosol-forming substrates may be stored together on the base layer. Alternatively, the plurality of aerosol-forming substrates may be stored separately. By separately storing two or more different portions of aerosol-forming substrate, it is possible to store two substances which are not entirely compatible in the same cartridge. Advantageously, separately storing two or more different portions of aerosol-forming substrate may extend the life of the cartridge. It also enables two incompatible substances to be stored in the same cartridge. Further, it enables the aerosol-forming substrates to be aerosolised separately, for example by heating each aerosol-forming substrate separately. Thus, aerosol-forming substrates with different heating profile requirements can be heated differently for improved aerosol formation. It may also enable more efficient energy use, since more volatile substances can be separately from less volatile substances and to a lesser degree. Separate aerosol-forming substrates can also be aerosolised in a predefined sequence, for example by heating a different one of the plurality of aerosol-forming substrates for each use, ensuring a 'fresh' aerosol-forming substrate is aerosolised each time the cartridge is used. In those embodiments comprising a liquid nicotine aerosol-forming substrate and a volatile delivery enhancing compound aerosol-forming substrate, the nicotine and the volatile delivery enhancing compound are advantageously stored separately and reacted together in the gas phase only when the system is in operation.

In some embodiments, the first aerosol-forming substrate on the first cartridge comprises a tobacco-based substrate, as described above, and the second aerosol-forming substrate comprises a liquid nicotine-containing substrate, as described above. Optionally, the second aerosol-forming substrate may further comprise a volatile delivery enhancing compound substrate, as described above.

Preferably each aerosol-forming substrate is substantially flat. Each aerosol-forming substrate may have any suitable cross-sectional shape. Preferably, each aerosol-forming substrate has a non-circular cross-sectional shape. In certain preferred embodiments, each aerosol-forming substrate has a substantially rectangular cross-sectional shape. In certain embodiments, each aerosol-forming substrate has an elongate, substantially rectangular, parallelepiped shape.

In certain preferred embodiments, each aerosol-forming substrate has a vaporisation temperature of from about 60 degrees Celsius to about 320 degrees Celsius, preferably from about 70 degrees Celsius to about 230 degrees Celsius, preferably from about 90 degrees Celsius to about 180 degrees Celsius.

In any of the embodiments described above, each resistive heater may comprise an electrically insulating substrate, wherein the heater comprises one or more substantially flat heater elements arranged on the electrically insulating substrate. The substrate may be flexible. The substrate may be polymeric. The substrate may be a multi-layer polymeric material. The heating element, or heating elements, may extend across one or more apertures in the substrate.

In use, each heater may be arranged to heat the respective aerosol-forming substrate by one or more of conduction, convection and radiation. The heater may heat the aerosol-forming substrate by means of conduction and may be at least partially in contact with the aerosol-forming substrate. Alternatively, or in addition, the heat from the heater may be conducted to the aerosol-forming substrate by means of an intermediate heat conductive element. Alternatively, or in addition, the heater may transfer heat to the incoming ambient air that is drawn through or past the cartridge during use, which in turn heats the aerosol-forming substrate by convection.

The heater may comprise an internal electric heating element for at least partially inserting into the aerosol-forming substrate. An "internal heating element" is one which is suitable for insertion into an aerosol-forming material. Alternatively or additionally, the electric heater may comprise an external heating element. The term "external heating element" refers to one that at least partially surrounds the aerosol-forming cartridge. The heater may comprise one or more internal heating elements and one or more external heating elements. The heater may comprise a single heating element. Alternatively, the heater may comprise more than one heating element.

Each heating element comprises an electrically resistive material. Suitable electrically resistive materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group. Examples of suitable metal alloys include stainless steel, nickel-, cobalt-, chromium-, aluminium- titanium-zirconium-, hafnium-, niobium-, molybdenum-, tantalum-, tungsten-, tin-, gallium-, manganese- and iron-containing alloys, and super-alloys based on nickel, iron, cobalt, stainless steel, Timetal® and iron-manganese-aluminium based alloys. In composite materials, the electrically resistive material may optionally be embedded in, encapsulated or coated with an insulating material or vice-versa, depending on the kinetics of energy transfer and the external physicochemical properties required. Alternatively, each heater may comprise an infra-red heating element, a photonic source, or an inductive heating element.

Each heater may take any suitable form. For example, each heater may take the form of a heating blade. Alternatively, each heater may take the form of a casing or substrate having different electro-conductive portions, or an electrically resistive metallic tube. Alternatively, each heater may comprise one or more heating needles or rods that run through the centre of the aerosol-forming substrate. Alternatively, each heater may be a disk (end) heater or a combination of a disk heater with heating needles or rods. Each heater may comprise one or more stamped portions of electrically resistive material, such as stainless steel. Other alternatives include a heating wire or filament, for example a Ni—Cr (Nickel-Chromium), platinum, tungsten or alloy wire or a heating plate.

In certain preferred embodiments, each heater comprises a plurality of electrically conductive filaments. The plurality of electrically conductive filaments may form a mesh or array of filaments or may comprise a woven or non-woven fabric.

The electrically conductive filaments may define interstices between the filaments and the interstices may have a width of between 10 μm and 100 μm. Preferably the filaments give rise to capillary action in the interstices, so that when the heater is placed in contact with a liquid-containing aerosol-forming substrate, liquid to be vapourised is drawn into the interstices, increasing the contact area between the heater assembly and the liquid. The electrically conductive filaments may form a mesh of size between 160 and 600 Mesh US (+/−10 percent) (i.e. between 160 and 600 filaments per inch (+/−10 percent). The width of the interstices is preferably between 25 μm and 75 μm. The percentage of open area of the mesh, which is the ratio of the area of the interstices to the total area of the mesh, is preferably between 25 percent and 56 percent. The mesh may be formed using different types of weave or lattice structures. The mesh, array or fabric of electrically conductive filaments may also be characterised by its ability to retain liquid, as is well understood in the art. The electrically conductive filaments may have a diameter of between 10 μm and 100 μm, preferably between 8 μm and 50 μm, and more preferably between 8 μm and 39 μm. The filaments may have a round cross section or may have a flattened cross-section. The heater filaments may be formed by etching a sheet material, such as a foil. This may be particularly advantageous when the heater comprises an array of parallel filaments. If the heater comprises a mesh or fabric of filaments, the filaments may be individually formed and knitted together. The electrically conductive filaments may be provided as a mesh, array or fabric. The area of the mesh, array or fabric of electrically conductive filaments may be small, preferably less than or equal to 25 square millimetres, allowing it to be incorporated in to a handheld system. The mesh, array or fabric of electrically conductive filaments may, for example, be rectangular and have dimensions of 5 mm by 2 mm. Preferably, the mesh or array of electrically conductive filaments covers an area of between 10 percent and 50 percent of the area of the heater. More preferably, the mesh or array of electrically conductive filaments covers an area of between 15 percent and 25 percent of the area of the heater.

In one embodiment, electric energy is supplied to each electric heater until the heating element or elements of the electric heater reach a temperature of between approximately 180 degrees Celsius and about 310 degrees Celsius. Any suitable temperature sensor and control circuitry may be used in order to control heating of the heating element or elements to reach the required temperature. This is in contrast to conventional cigarettes in which the combustion of tobacco and cigarette wrapper may reach 800 degrees Celsius.

Preferably, the minimum distance between each electric heater and the respective aerosol-forming substrate is less than 50 micrometres, preferably each cartridge comprises one or more layers of capillary fibres in the space between the electric heater and the aerosol-forming substrate.

Each heater may comprise one or more heating elements above the aerosol-forming substrate. Alternatively, each heater may comprise one or more heating elements below the aerosol-forming substrate. With this arrangement, heating of the aerosol-forming substrate and aerosol release occur on opposite sides of the aerosol-forming cartridge. This has been found to be particularly effective for aerosol-forming substrates which comprise a tobacco-containing material. In certain embodiments, each heater comprises one or more heating elements positioned adjacent to opposite sides of the aerosol-forming substrate. Preferably each heater comprises a plurality of heating elements arranged to heat a different portion of the aerosol-forming substrate. In certain preferred embodiments, each aerosol-forming substrate comprises a plurality of aerosol-forming substrates arranged separately on a base layer and the respective heater comprises a plurality of heating elements each arranged to heat a different one of the plurality of aerosol-forming substrates.

Each aerosol-forming cartridge may have any suitable size. Preferably, each cartridge has suitable dimensions for use with a handheld aerosol-generating device. In certain embodiments, each cartridge has length of from about 5 mm to about 200 mm, preferably from about 10 mm to about 100 mm, more preferably from about 20 mm to about 35 mm. In certain embodiments, each cartridge has width of from about 5 mm to about 12 mm, preferably from about 7 mm to about 10 mm. In certain embodiments, each cartridge has a height of from about 2 mm to about 10 mm, preferably from about 5 mm to about 8 mm.

In use, at least one of the aerosol-forming cartridge and the aerosol-generating device may be connected to a separate mouthpiece portion by which a user can draw a flow of air through or adjacent to the cartridge by sucking on a downstream end of the mouthpiece portion. In such embodiments, preferably, the cartridge is arranged such that the resistance to draw at a downstream end of the mouthpiece portion is from about 50 mmWG to about 130 mmWG, more preferably from about 80 mmWG to about 120 mmWG, more preferably from about 90 mmWG to about 110 mmWG, most preferably from about 95 mmWG to about 105 mmWG. As used herein, the term "resistance to draw" refers the pressure required to force air through the full length of the object under test at a rate of 17.5 ml/sec at 22° C. and 101 kPa (760 Torr). Resistance to draw is typically expressed in units of millimetres water gauge (mmWG) and is measured in accordance with ISO 6565:2011.

As described above, each aerosol-forming cartridge may comprise one or more electrical contacts. The electrical contacts provided on the aerosol-forming cartridge may be accessible from outside of the cartridge. The electrical contacts may be positioned along one or more edges of the cartridge. In certain embodiments, the electrical contacts may be positioned along a lateral edge of the cartridge. For example, the electrical contacts may be positioned along the upstream edge of the cartridge. Alternatively, or in addition, the electrical contacts may be positioned along a single longitudinal edge of the cartridge. The electrical contacts on the cartridge may comprise data contacts for transferring data to or from the cartridge, or both to and from the cartridge.

In any of the embodiments described above, each cartridge may comprise a cover layer fixed to a base layer and over at least part of the at least one aerosol-forming substrate. Advantageously, the cover layer may hold the at least one aerosol-forming substrate in place on the base layer. The cover layer may be fixed directly to the base layer, or indirectly via one or more intermediate layers or components. Aerosol released by the aerosol-forming substrate may pass through one or more apertures in the cover layer, base layer, or both. The cover layer may have at least one gas permeable window to allow aerosol released by the aerosol-forming substrate to pass through the cover layer. The gas permeable window may be substantially open. Alternatively, the gas permeable window may comprise a perforated membrane, or a grid extending across an aperture in the cover layer. The grid may be of any suitable form, such as a transverse grid, longitudinal grid, or mesh grid. The cover layer may form a seal with the base layer. The cover layer may form a hermetic seal with the base layer. The cover layer may comprise a polymeric coating at least where the cover layer is fixed to the base layer, the polymeric coating forming a seal between the cover layer and the base layer.

Each aerosol-forming cartridge may comprise a protective foil positioned over at least part of the at least one aerosol-forming substrate. The protective foil may be gas impermeable. The protective foil may be arranged to hermetically seal the aerosol-forming substrate within the cartridge. As used herein, the term "hermetically seal" means that the weight of the volatile compounds in the aerosol-forming substrate changes by less than 2% over a two week period, preferably over a two month period, more preferably over a two year period.

The base layer may comprise at least one cavity in which the aerosol-forming substrate is held. In these embodiments, the protective foil may be arranged to close the one or more cavities. The protective foil may be at least partially removable to expose the at least one aerosol-forming substrate. Preferably, the protective foil is removable. Where the base layer comprises a plurality of cavities in which a plurality of aerosol-forming substrates are held, the protective foil may be removable in stages to selectively unseal one or more of the aerosol-forming substrates. For example, the protective foil may comprise one or more removable sections, each of which is arranged to reveal one or more of the cavities when removed from the remainder of the protective foil. Alternatively, or in addition, the protective foil may be attached such that the required removal force varies between the various stages of removal as an indication to the user. For example, the required removal force may increase between adjacent stages so that the user must deliberately pull harder on the protective foil to continue removing the protective foil. This may be achieved by any suitable means. For example, the pulling force may be varied by altering the type, quantity, or shape of an adhesive layer, or by altering the shape or amount of a weld line by which the protective foil is attached.

The protective foil may be removably attached to the base layer either directly or indirectly via one or more intermediate components. Where the cartridge comprises a cover layer as described above, the protective foil may be removably attached to the cover layer. Where the cover layer has one or more gas permeable windows, the protective foil may extend across and close the one or more gas permeable windows. The protective foil may be removably attached by any suitable method, for example using adhesive. The protective foil may be removably attached by ultrasonic welding. The protective foil may be removably attached by ultrasonic welding along a weld line. The weld line may be continuous. The weld line may comprise two or more continuous weld lines arranged side by side. With this arrangement, the seal can be maintained provided at least one of the continuous weld lines remains intact.

The protective foil may be a flexible film. The protective foil may comprise any suitable material or materials. For example, the protective foil may comprise a polymeric foil, for example Polypropylene (PP) or Polyethylene (PE). The protective foil may comprise a multilayer polymeric foil.

The electric power supply may be a DC voltage source. In preferred embodiments, the power supply is a battery. For example, the power supply may be a Nickel-metal hydride battery, a Nickel cadmium battery, or a Lithium based battery, for example a Lithium-Cobalt, a Lithium-Iron-Phosphate or a Lithium-Polymer battery. The power supply may alternatively be another form of charge storage device such as a capacitor. The power supply may require recharging and may have a capacity that allows for the storage of enough energy for use of the aerosol-generating device with one or more aerosol-forming cartridges.

The aerosol-generating device may comprise one or more temperature sensors configured to sense the temperature of at least one of the heater and the one or more aerosol-forming substrates. In such embodiments, the controller may be configured to control the supply of power to the heater based on the sensed temperature.

In those embodiments in which each heater comprises at least one resistive heating element, the at least one heater element may be formed using a metal having a defined relationship between temperature and resistivity. In such embodiments, the metal may be formed as a track between two layers of suitable insulating materials. A heater element formed in this manner may be used both as a heater and a temperature sensor.

In any of the embodiments described above, the aerosol-generating device may comprise an external plug or socket allowing the aerosol-generating device to be connected to another electrical device. For example, the aerosol-generating device may comprise a USB plug or a USB socket to allow connection of the aerosol-generating device to another USB enabled device. For example, the USB plug or socket may allow connection of the aerosol-generating device to a USB charging device to charge a rechargeable power supply within the aerosol-generating device. Additionally, or alternatively, the USB plug or socket may support the transfer of data to or from, or both to and from, the aerosol-generating device. For example, the device may be connected to a computer to download data from the device, such as usage data. Additionally, or alternatively, the device may be connected to a computer to transfer data to the device, such as new heating profiles for new or updated aerosol-forming cartridges, wherein the heating profiles are stored within a data storage device within the aerosol-generating device.

In those embodiments in which the device comprises a USB plug or socket, the device may further comprise a removable cover that covers the USB plug or socket when not in use. In embodiments in which the USB plug or socket is a USB plug, USB plug may additionally or alternatively be selectively retractable within the device.

The invention will now be further described, by way of example only, with reference to the accompanying drawings in which.

Figure 1:
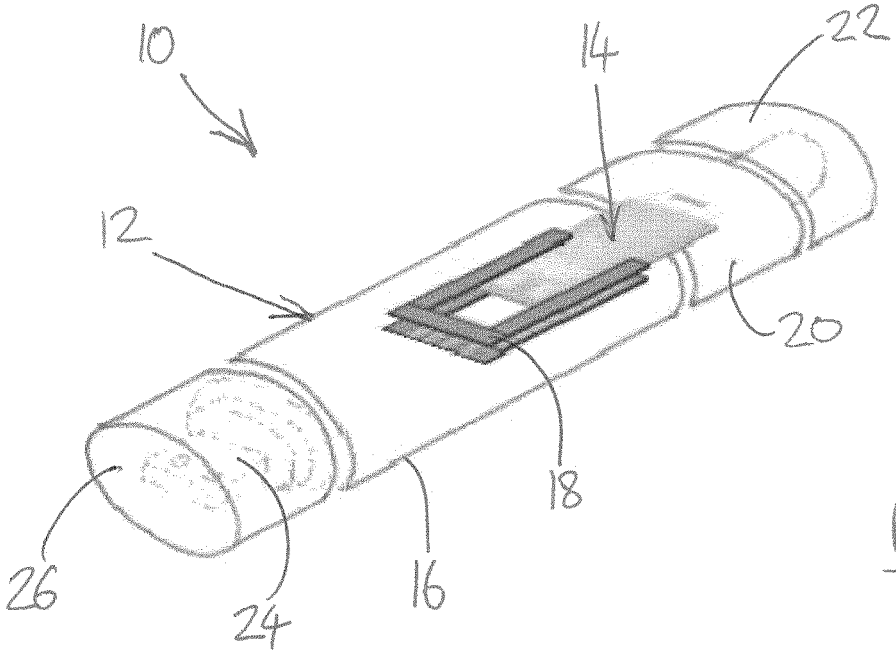
FIG. 1 shows an aerosol-generating system comprising an aerosol-generating device and an aerosol-forming cartridge, in accordance with an embodiment of the present invention.

FIG. 1 shows an aerosol-generating system 10 in accordance with an embodiment of the present invention, the aerosol-generating system 10 comprising an aerosol-generating device 12 and an aerosol-forming cartridge 14. The aerosol-generating device 12 comprises a main body 16 defining a cavity comprising an opening at a downstream end of the main body 16 through which the aerosol-forming cartridge 14 is inserted into the cavity. The device 12 further comprises an electrical contact assembly 18 provided adjacent the opening for receiving the aerosol-forming cartridge therein.

A removable mouthpiece 20 is provided at an upstream end of the device 12, wherein the mouthpiece 20 is removed from the device 12 to allow insertion of the aerosol-forming cartridge 14 into the device 12, and the mouthpiece 20 is then reattached to the device 12 after the aerosol-forming cartridge 14 has been fully inserted. A removable mouthpiece cover 22 covers the mouthpiece 20 when the device 12 is not in use.

A USB plug 24 is provided at a downstream end of the device 12 for insertion into a suitable USB socket. The USB plug 24 can be used for charging a rechargeable battery within the device 12, as well as exchanging data with the device 12. For example, the USB plug 24 can be used to download usage data from the device 12, as well as uploading new data to the device 12, such as new heating profiles. A removable cover 26 covers the USB plug 24 when the USB plug 24 is not in use.

Figure 2:
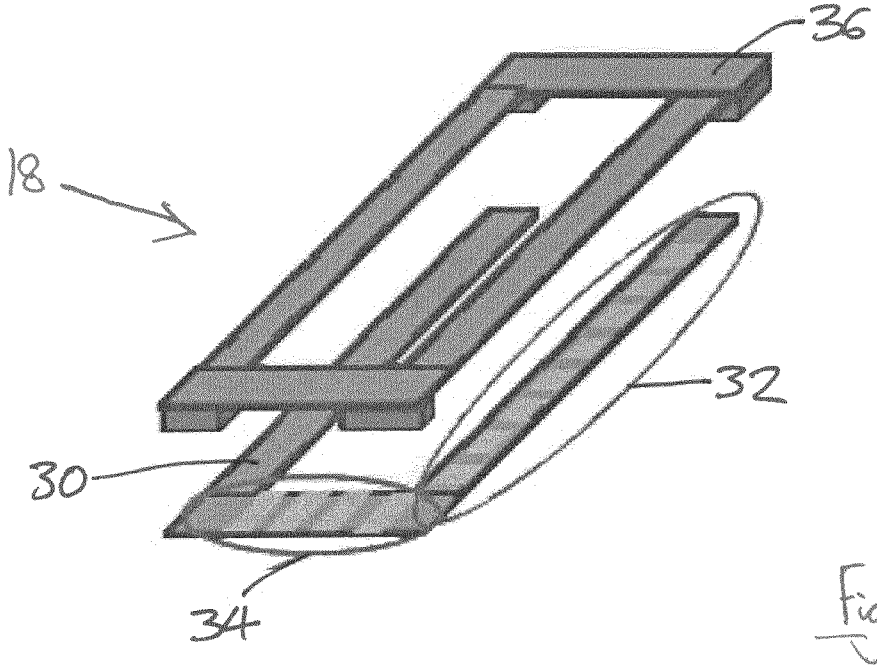
FIG. 2 shows an exploded view of the electrical contact assembly of the aerosol-generating device shown in FIG. 1.
Figure 3:
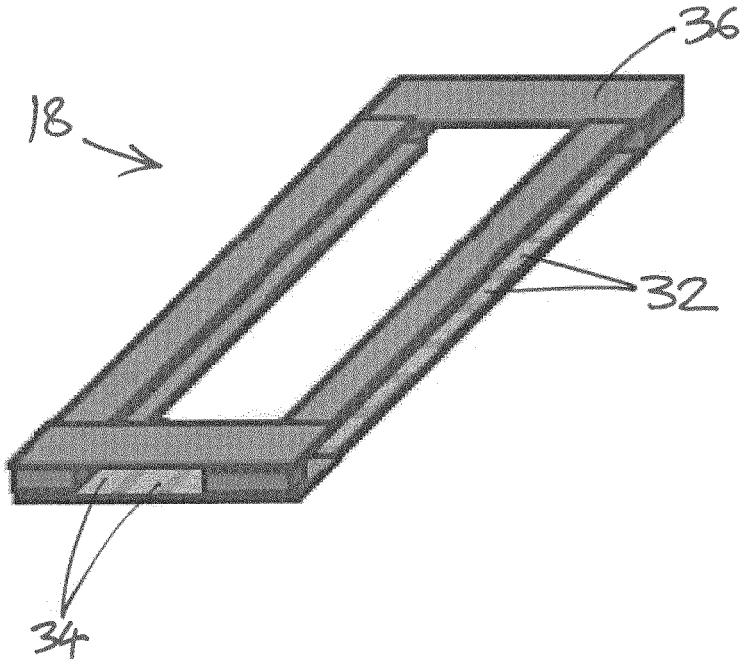
FIG. 3 shows the electrical contact assembly of FIG. 2 in a fully assembled configuration.

The electrical contact assembly 18 of the aerosol-generating device 12 is shown in more detail in FIGS. 2 and 3. The electrical contact assembly 18 comprises an electrically insulating substrate layer 30 on which a plurality of electrical contacts is provided. The electrical contacts comprise a first set of electrical contacts 32 provided on a side edge of the substrate layer 30 and a second set of electrical contacts 34 provided on an upstream end edge of the substrate layer 30. A guide rail assembly 36 overlies and is secured to the electrically insulating substrate layer 32 to form a slot therebetween for receiving the aerosol-forming cartridge 14.

Figure 4:
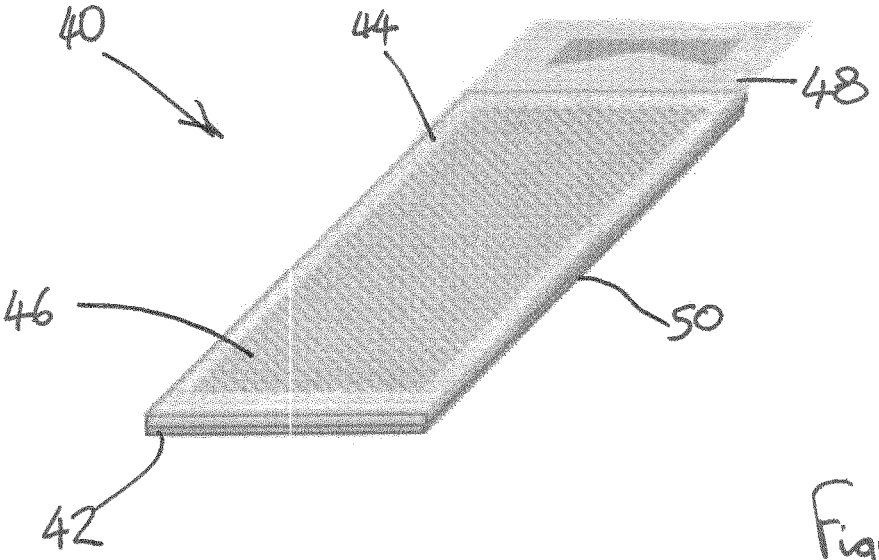
FIG. 4 shows a first aerosol-forming cartridge for use with the aerosol-generating device shown in FIG. 1.

FIG. 4 shows a first aerosol-forming cartridge 40 for use with the aerosol-generating device 12. The cartridge 40 comprises a base layer 42 on which a plurality of electric heater elements is mounted. A solid tobacco-based aerosol-forming substrate is provided in thermally conductive contact with the heater elements and a cover layer 44 overlies the aerosol-forming substrate and is secured to the base layer 42. The cover layer 44 comprises a mesh grid 46 overlying the aerosol-forming substrate to allow the aerosol particles to escape from the first aerosol-forming cartridge 40 during heating. A removable polymeric film 48 overlies the mesh grid 46 to prevent premature escape of the volatile components from the aerosol-forming substrate. Before using the cartridge 40, the polymeric film 48 is removed.

Figure 5:
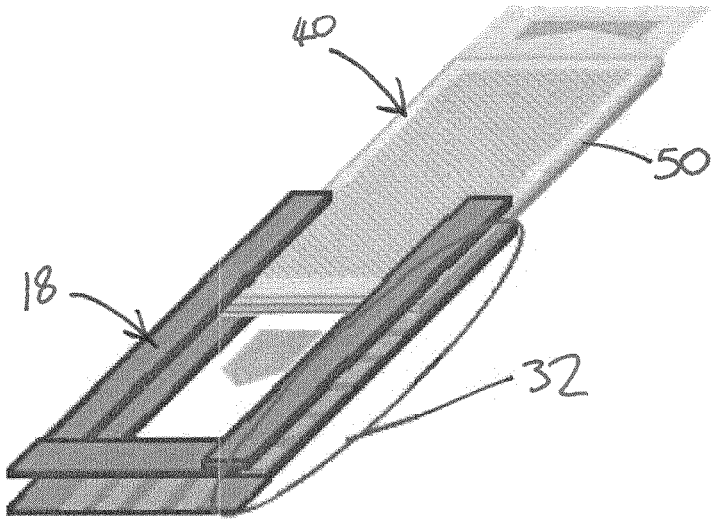
FIG. 5 shows the first aerosol-forming cartridge of FIG. 4 partially inserted into the electrical contact assembly of FIG. 3.

The first aerosol-forming cartridge 40 also comprises a set of electrical contacts provided on an underside of the base layer 42 along a side edge 50 of the cartridge 40. As shown in FIG. 5, when the first aerosol-forming cartridge 40 is inserted into the electrical contact assembly 18 of the aerosol-generating device 12, the electrical contacts on the underside of the base layer 42 contact the first set of electrical contacts 32 on the side edge of the electrical contact assembly 18. In use, a control unit within the device 12 detects the electrical contact with the first set of electrical contacts 32 and detects the resistive load of the plurality of electric heater elements, and therefore determines that a type of aerosol-forming cartridge corresponding to the first aerosol-forming cartridge 40 has been inserted into the device 12. In use, the control unit provides electrical power from a power supply to the heater elements within the cartridge 40 via the first set of electrical contacts 32 and the electrical contacts on the cartridge 40, in accordance with a first heating profile.

Figure 6:
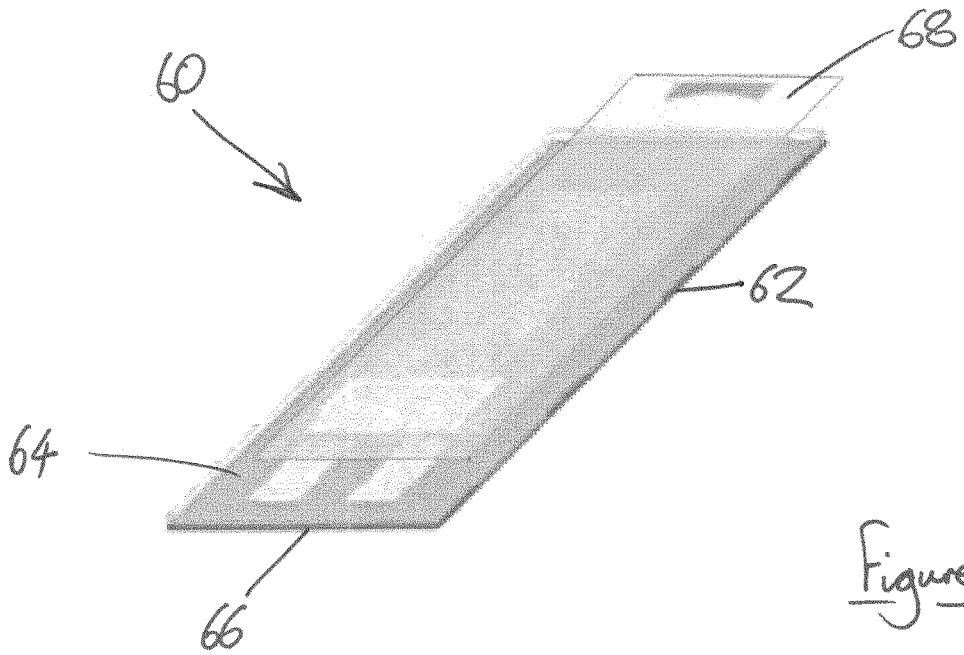
FIG. 6 shows a second aerosol-forming cartridge for use with the aerosol-generating device shown in FIG. 1.

FIG. 6 shows a second aerosol-forming cartridge 60 for use with the aerosol-generating device 12. The cartridge 60 comprises a base layer 62 on which an aerosol-forming substrate is provided. The aerosol-forming substrate comprises a porous element containing a nicotine solution. An electrically conductive heating mesh 64 overlies the aerosol-forming substrate and is connected to a set of electrical contacts provided on an underside of the base layer 62 along the upstream edge 66 of the cartridge 60. A removable polymeric film 68 overlies the electrically conductive heating mesh 64 to prevent premature escape of the volatile components from the aerosol-forming substrate. Before using the cartridge 60, the polymeric film 68 is removed.

Figure 7:
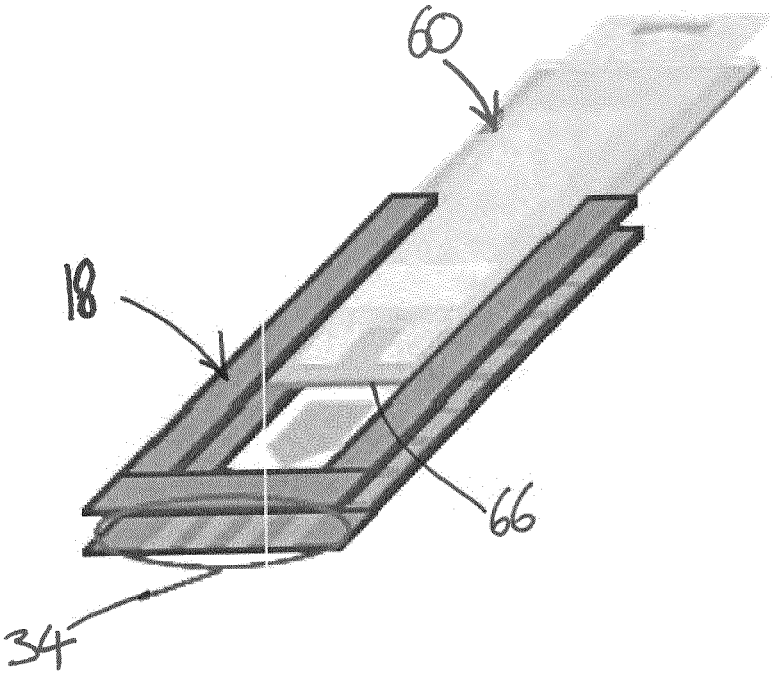
FIG. 7 shows the second aerosol-forming cartridge of FIG. 6 partially inserted into the electrical contact assembly of FIG. 3.

As shown in FIG. 7, when the second aerosol-forming cartridge 60 is inserted into the electrical contact assembly 18 of the aerosol-generating device 12, the electrical contacts on the underside of the base layer 62 contact the second set of electrical contacts 34 on the upstream edge of the electrical contact assembly 18. In use, the control unit within the device 12 detects the electrical contact with the second set of electrical contacts 34 and the resistive load of the electrically conductive heating mesh 64, and therefore determines that a type of aerosol-forming cartridge corresponding to the second aerosol-forming cartridge 60 has been inserted into the device 12. In use, the control unit provides electrical power from the power supply to the electrically conductive heating mesh 64 within the cartridge 60 via the second set of electrical contacts 34 and the electrical contacts on the cartridge 60, in accordance with a second heating profile.

The invention claimed is:

1. An electrically operated aerosol-generating system comprising an aerosol-generating device, a mouthpiece, a first removable aerosol-forming cartridge comprising at least a first resistive heater, and a second removable aerosol-forming cartridge comprising at least a second resistive heater, the first removable aerosol-forming cartridge further comprising a first aerosol-forming substrate having a first heating profile, and the second removable aerosol-forming cartridge further comprising a second aerosol-forming substrate having a second heating profile, the aerosol-generating device comprising:

a main body defining a cavity and at least one opening configured to removably receive the first removable aerosol-forming cartridge or the second removable aerosol-forming cartridge in the cavity;

an electrical contact assembly disposed within the main body and being configured to remain disposed within the main body when the first removable aerosol-forming cartridge and the second removable aerosol-forming cartridge are removed from the cavity;

an electrical power supply; and a controller configured to control a supply of electrical current from the electrical power supply to the first resistive heater or the second resistive heater via the electrical contact assembly, wherein the first removable aerosol-forming cartridge further comprises a first electrical load comprising a first resistive load of the first resistive heater and is configured to electrically connect with the controller when the first removable aerosol-forming cartridge is received in the cavity, wherein the second removable aerosol-forming cartridge further comprises a second electrical load comprising a second resistive load of the second resistive heater and is configured to electrically connect with the controller when the second removable aerosol-forming cartridge is received in the cavity, the second electrical load being different than the first electrical load, and wherein the controller is further configured to measure the first electrical load or the second electrical load, respectively, when the first removable aerosol-forming cartridge or the second removable aerosol-forming cartridge is received in the cavity, detect whether the first removable aerosol-forming cartridge or the second removable aerosol-forming cartridge has been received in the cavity, and control the supply of electrical current to the first resistive heater or the second resistive heater according to either the first heating profile or the second heating profile based at least in part on the measured first electrical load or the measured second electrical load.

2. The electrically operated aerosol-generating system according to claim 1, wherein the first removable aerosol-forming cartridge further comprises a first data storage device configured to communicate first data to the controller when the first removable aerosol-forming cartridge is received within the cavity, wherein the second removable aerosol-forming cartridge further comprises a second data storage device configured to communicate second data to the controller when the second removable aerosol-forming cartridge is received within the cavity, wherein the second data is different from the first data, and wherein the controller is further configured to control the supply of electrical current to the first resistive heater or the second resistive heater according to either the first heating profile or the second heating profile based at least in part on the first data or the second data, respectively, received by the control unit.

3. The electrically operated aerosol-generating system according to claim 1, wherein the electrical contact assembly comprises a first set of electrical contacts and a second set of electrical contacts, wherein the first removable aerosol-forming cartridge comprises a third set of electrical contacts arranged to contact the first set of electrical contacts when the first removable aerosol-forming cartridge is received in the cavity, wherein the second removable aerosol-forming cartridge comprises a fourth set of electrical contacts arranged to contact the second set of electrical contacts when the second removable aerosol-forming cartridge is received in the cavity, and wherein the controller is further configured to control the supply of electrical current to the first resistive heater or the second resistive heater according to either the first heating profile or the second heating profile based in part on whether the first removable aerosol-forming cartridge or the second removable aerosol-forming cartridge respectively received within the cavity contacts the first set of electrical contacts or the second set of electrical contacts.

4. The electrically operated aerosol-generating system according to claim 3, wherein the first set of electrical contacts and the second set of electrical contacts share at least one common electrical contact.

5. The electrically operated aerosol-generating system according to claim 1, wherein the at least one opening comprises a first opening configured to receive the first removable aerosol-forming cartridge and a second opening configured to receive the second removable aerosol-forming cartridge.

6. The electrically operated aerosol-generating system according to claim 5, wherein the first opening and the second opening are configured so that the first removable aerosol-forming cartridge is receivable only within the first opening and the second removable aerosol-forming cartridge is receivable only within the second opening, and wherein the controller is further configured to control the supply of electrical current to the first resistive heater or the second resistive heater according to either the first heating profile or the second heating profile based in part on whether the first removable aerosol-forming cartridge or the second removable aerosol-forming cartridge is respectively received within the first opening or the second opening.

7. The electrically operated aerosol-generating system according to claim 6, wherein the first removable aerosol-forming cartridge and the second removable aerosol-forming cartridge have at least one of a different size and a different shape.

8. The electrically operated aerosol-generating system according to claim 7, wherein the first opening is disposed at an end wall of the cavity, and wherein the second opening is disposed along a side wall of the cavity.

9. The electrically operated aerosol-generating system according to claim 8, wherein the first removable aerosol-forming cartridge has a greater maximum length than the second removable aerosol-forming cartridge, and the second removable aerosol-forming cartridge has a greater maximum width than the first removable aerosol-forming cartridge, wherein the first opening has a maximum width less than a maximum width of the second removable aerosol-forming cartridge, and wherein the second opening has a maximum length less than a maximum length of the first removable aerosol-forming cartridge.

10. The electrically operated aerosol-generating system according to claim 1, wherein the cavity comprises at least one of a guide slot, a groove, a rail, or a protrusion, configured to guide one or both of the first removable aerosol-forming cartridge and the second removable aerosol-forming cartridge into a correct position within the cavity.

11. The electrically operated aerosol-generating system according to claim 1, wherein the first removable aerosol-forming cartridge and the second removable aerosol-forming cartridge are flat, and wherein the at least one opening comprises a rectangular slot.

12. The electrically operated aerosol-generating system according to claim 1, wherein the first aerosol-forming substrate and the second aerosol-forming substrate each comprise nicotine.

13. The electrically operated aerosol-generating system according to claim 12, wherein the first aerosol-forming substrate comprises tobacco, and wherein the second aerosol-forming substrate comprises a nicotine solution or a nicotine salt.

* * * * *